US010364607B2

(12) United States Patent
Stokes et al.

(10) Patent No.: US 10,364,607 B2
(45) Date of Patent: Jul. 30, 2019

(54) WHIPSTOCK ASSEMBLIES WITH A RETRACTABLE TENSION ARM

(71) Applicant: Halliburton Energy Services, Inc., Houston, TX (US)

(72) Inventors: Matthew Bradley Stokes, Keller, TX (US); Loc Phuc Lang, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/531,720

(22) PCT Filed: Sep. 27, 2016

(86) PCT No.: PCT/US2016/053894

§ 371 (c)(1),
(2) Date: May 30, 2017

(87) PCT Pub. No.: WO2018/063147

PCT Pub. Date: Apr. 5, 2018

(65) Prior Publication Data

US 2018/0258700 A1 Sep. 13, 2018

(51) Int. Cl.
*E21B 7/06* (2006.01)
*E21B 7/04* (2006.01)

(52) U.S. Cl.
CPC ..... *E21B 7/061* (2013.01); *E21B 7/04* (2013.01); *E21B 7/06* (2013.01)

(58) Field of Classification Search
CPC ..... E21B 7/061
USPC ..... 166/117.6
See application file for complete search history.

(56) References Cited

U.S. PATENT DOCUMENTS

| | | | | |
|---|---|---|---|---|
| 2,669,429 | A * | 2/1954 | Zublin | E21B 7/061 175/74 |
| 3,866,628 | A * | 2/1975 | Weber | E21B 23/002 137/625.44 |
| 3,908,759 | A | 9/1975 | Cagle et al. | |
| 5,341,873 | A | 8/1994 | Carter et al. | |
| 5,431,220 | A | 7/1995 | Lennon et al. | |
| 5,474,126 | A | 12/1995 | Lynde et al. | |
| 5,531,271 | A | 7/1996 | Carter | |
| 5,551,509 | A | 9/1996 | Braddick | |
| 5,720,349 | A | 2/1998 | Pleasants et al. | |
| 5,826,651 | A | 10/1998 | Lee et al. | |
| 5,911,275 | A * | 6/1999 | McGarian | E21B 7/061 166/117.6 |

(Continued)

OTHER PUBLICATIONS

International Search Report and Written Opinion for PCT/US2016/053894, dated Mar. 17, 2017.

*Primary Examiner* — Taras P Bemko
(74) *Attorney, Agent, or Firm* — Scott Richardson; C. Tumey Law Group PLLC

(57) ABSTRACT

A whipstock assembly includes a whipstock providing a ramped surface, and a mill releasably coupled to the whipstock with a shear bolt and providing a mill profile. A tension arm is pivotably coupled to the whipstock and movable between a stowed position, where the tension arm is received within a cavity defined in the ramped surface, and an engaged position, where an engagement head of the tension arm mates with the mill profile to assume at least a portion of a tensile load assumed by the shear bolt.

20 Claims, 5 Drawing Sheets

(56) References Cited

U.S. PATENT DOCUMENTS

| | | | | |
|---|---|---|---|---|
| 6,209,653 | B1 | 4/2001 | Pringle | |
| 6,302,198 | B1 | 10/2001 | Ritorto et al. | |
| 6,464,002 | B1 | 10/2002 | Hart et al. | |
| 6,880,631 | B1 | 4/2005 | McGarian et al. | |
| 7,610,971 | B2 | 11/2009 | Neff | |
| 8,069,920 | B2 | 12/2011 | Cronley et al. | |
| 8,469,096 | B2 | 6/2013 | McGarian | |
| 9,228,422 | B2 | 1/2016 | Watson et al. | |
| 2002/0043404 | A1* | 4/2002 | Trueman | E21B 7/061 175/45 |
| 2002/0170713 | A1 | 11/2002 | Haugen et al. | |
| 2005/0039905 | A1* | 2/2005 | Hart | E21B 10/55 166/55.7 |
| 2010/0224372 | A1 | 9/2010 | Stowe et al. | |
| 2012/0222902 | A1* | 9/2012 | Alsup | E21B 29/06 175/61 |
| 2012/0241144 | A1* | 9/2012 | Bell | E21B 7/061 166/117.5 |
| 2012/0255785 | A1* | 10/2012 | Gregurek | E21B 7/061 175/57 |
| 2012/0261130 | A1* | 10/2012 | Linn | E21B 41/0035 166/313 |
| 2014/0190688 | A1 | 7/2014 | Cronley et al. | |
| 2014/0262528 | A1 | 9/2014 | Desai et al. | |
| 2014/0374119 | A1 | 12/2014 | Dewars et al. | |
| 2015/0021029 | A1 | 1/2015 | Abrant et al. | |
| 2016/0258236 | A1* | 9/2016 | Vemuri | E21B 29/06 |
| 2016/0258237 | A1 | 9/2016 | Lang et al. | |

* cited by examiner

WHIPSTOCK ASSEMBLIES WITH A RETRACTABLE TENSION ARM

BACKGROUND

Hydrocarbons can be produced from wellbores of varying complexity that traverse one or more hydrocarbon-bearing subterranean formations. Multilateral wellbores, for example, include any number of lateral wellbores extending from a parent wellbore. In an example implementation, a casing exit (alternately referred to as a "window") is provided in the parent wellbore at each lateral wellbore junction, and each casing exit allows the respective lateral wellbore to be drilled from the parent wellbore. The casing exit can be formed by positioning a whipstock in the parent wellbore and deflecting a mill laterally into the inner wall of casing or liner that lines the wellbore. The mill penetrates the casing to form the casing exit, following which a drill bit can be inserted through the casing exit to drill the lateral wellbore to a desired depth.

Some whipstocks are designed to allow a well operator to run the whipstock and one or more mills downhole together in a single run, which greatly reduces the time and expense of completing a multilateral wellbore. Such whipstock designs will typically anchor the mills to the whipstock using a shear bolt, which is designed to fail (shear) upon application of downward weight when a well operator desires to free the mills from the whipstock. The shear bolt is typically not designed to shear in torque, and if the shear bolt prematurely shears in torque as the whipstock is run downhole, the whipstock will have to be returned to the well surface and the shear bolt replaced.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to multilateral wells in the oil and gas industry and, more particularly, to whipstock assemblies that include a tension arm used to mitigate the tensile loads assumed by a shear bolt that couples a mill to a whipstock.

The embodiments discussed herein describe a whipstock assembly having an increased torque rating. The whipstock assembly includes a mill releasably coupled to a whipstock with a shear bolt and providing a mill profile. A tension arm is pivotably coupled to the whipstock and movable between a stowed position, where the tension arm is received within a cavity defined in the ramped surface, and an engaged position, where an engagement head of the tension arm mates with the mill profile. A support button radially supports the mill and thereby reduces the bending loads seen by the shear bolt, and the tension arm shares the tensile loads assumed by the shear bolt. The combination of the tension arm and the support button effectively increases the cross-sectional area of the shear bolt in tension, without affecting its shear value.

Figure 1:
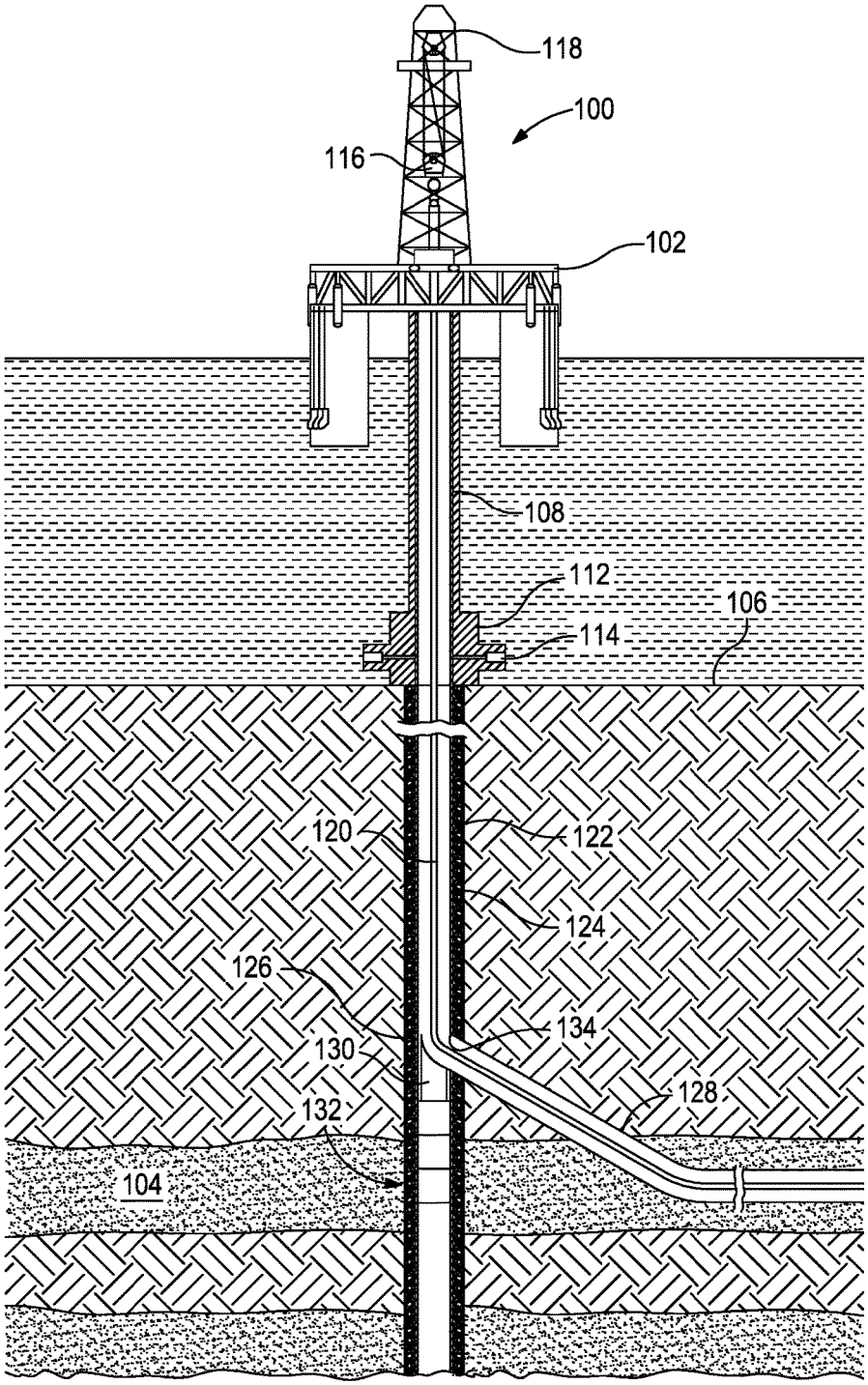
FIG. 1 is a schematic diagram of an exemplary well system that may incorporate the principles of the present disclosure.

FIG. 1 depicts an exemplary well system 100 that may incorporate the principles of the present disclosure. As illustrated, the well system 100 may include a semi-submersible platform 102 centered over a submerged oil and gas formation 104 located below a sea floor 106. A subsea conduit 108 or riser extends from the deck of the platform 102 to a wellhead installation 112 that includes one or more blowout preventers 114. The platform 102 has a hoisting apparatus 116 and a derrick 118 for raising and lowering a work string 120 within the subsea conduit 108. The work string 120 may comprise, for example, a string of tubulars connected end to end, such as drill pipe or production tubing, but may alternatively comprise coiled tubing without departing from the scope of the disclosure.

It is noted that even though FIG. 1 depicts the well system 100 as including the offshore oil and gas platform 102, it will be appreciated by those skilled in the art that the various embodiments of the present disclosure are equally well suited for use in or on other types of oil and gas rigs, such as any land-based oil and gas rig or rigs located at any other geographical site.

As depicted, a parent wellbore 122 has been drilled through the various earth strata, including the formation 104. A string of casing 124 is cemented into at least a portion of the parent wellbore 122. The term "casing" is used herein to designate a string of tubulars or pipe used to line a wellbore. The casing may actually be of the type known to those skilled in the art as "liner" and may be segmented or continuous, such as coiled tubing.

A casing joint 126 may be interconnected between elongate portions or lengths of the casing 124 and positioned at a desired location within the parent wellbore 122 where a lateral wellbore 128 is to be drilled. A whipstock assembly 130 may be positioned within the casing 124 and/or the casing joint 126 and otherwise anchored therein using an anchor assembly 132 arranged at or near the casing joint 126. Once secured within the parent wellbore 122, the whipstock assembly 130 may be operable to deflect one or more cutting tools (i.e., mills) into the inner wall of the casing joint 126 such that a casing exit 134 is formed therein at a desired circumferential (azimuthal) location. The casing exit 134 provides a "window" in the casing joint 126 through which one or more additional cutting tools (i.e., drill bits) may be inserted in order to drill the lateral wellbore 128. In some embodiments, however, the casing joint 126 may be omitted from the well system 100 and the casing exit 134 may alternatively be formed in a corresponding section of the casing 124, without departing from the scope of the disclosure.

While the parent wellbore 122 is depicted as having a single lateral wellbore 128 extending therefrom, the whipstock assembly 130 can be used in wellbores having multiple lateral wellbores. In addition, even though FIG. 1 depicts the parent wellbore 122 as extending substantially vertical, the embodiments described herein are equally applicable for use in wellbores having other directional configurations, such as horizontal, deviated, slanted, diagonal, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
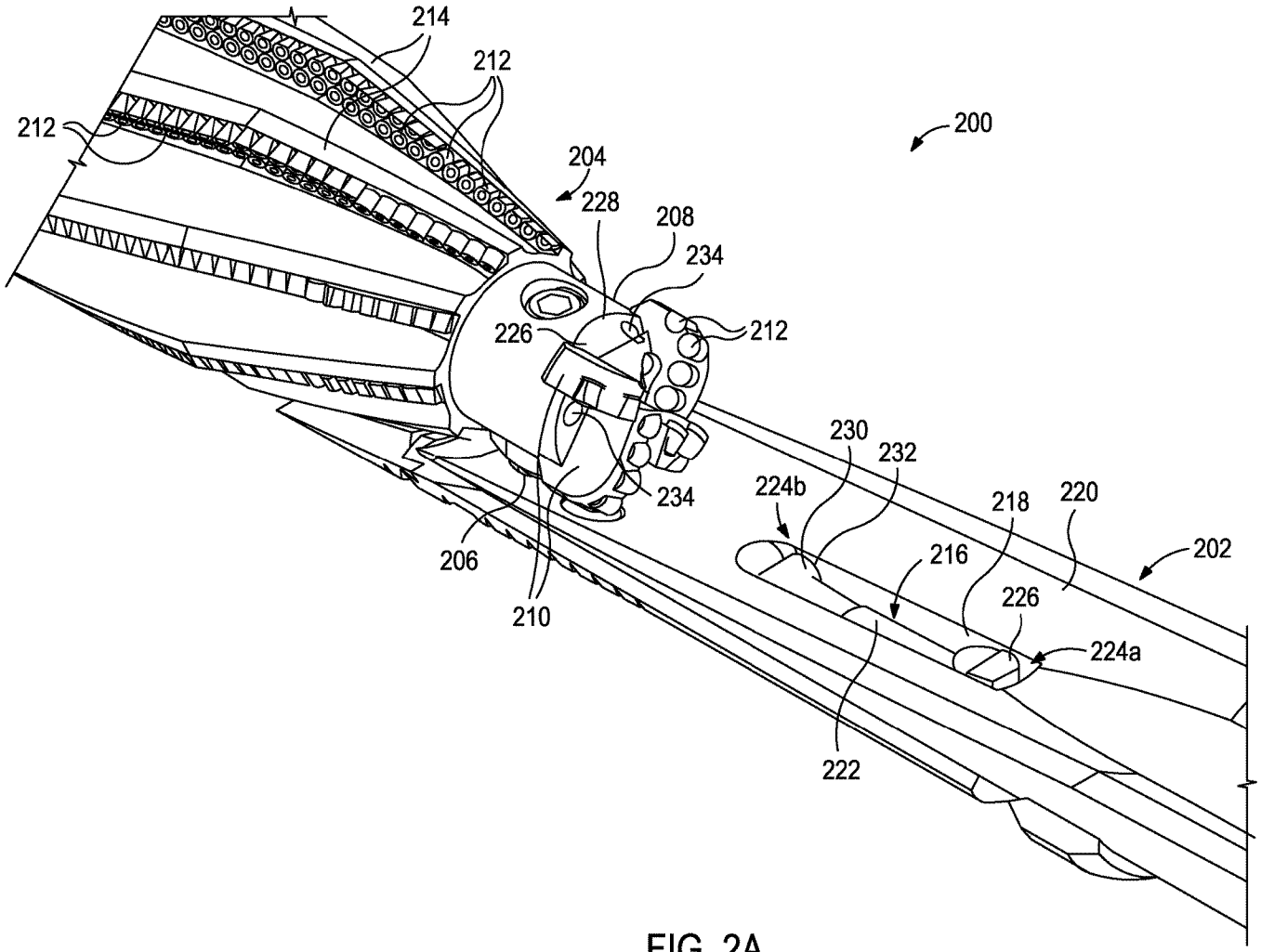
FIGS. 2A and 2B are isometric views of an exemplary whipstock assembly.
Figure 2B:
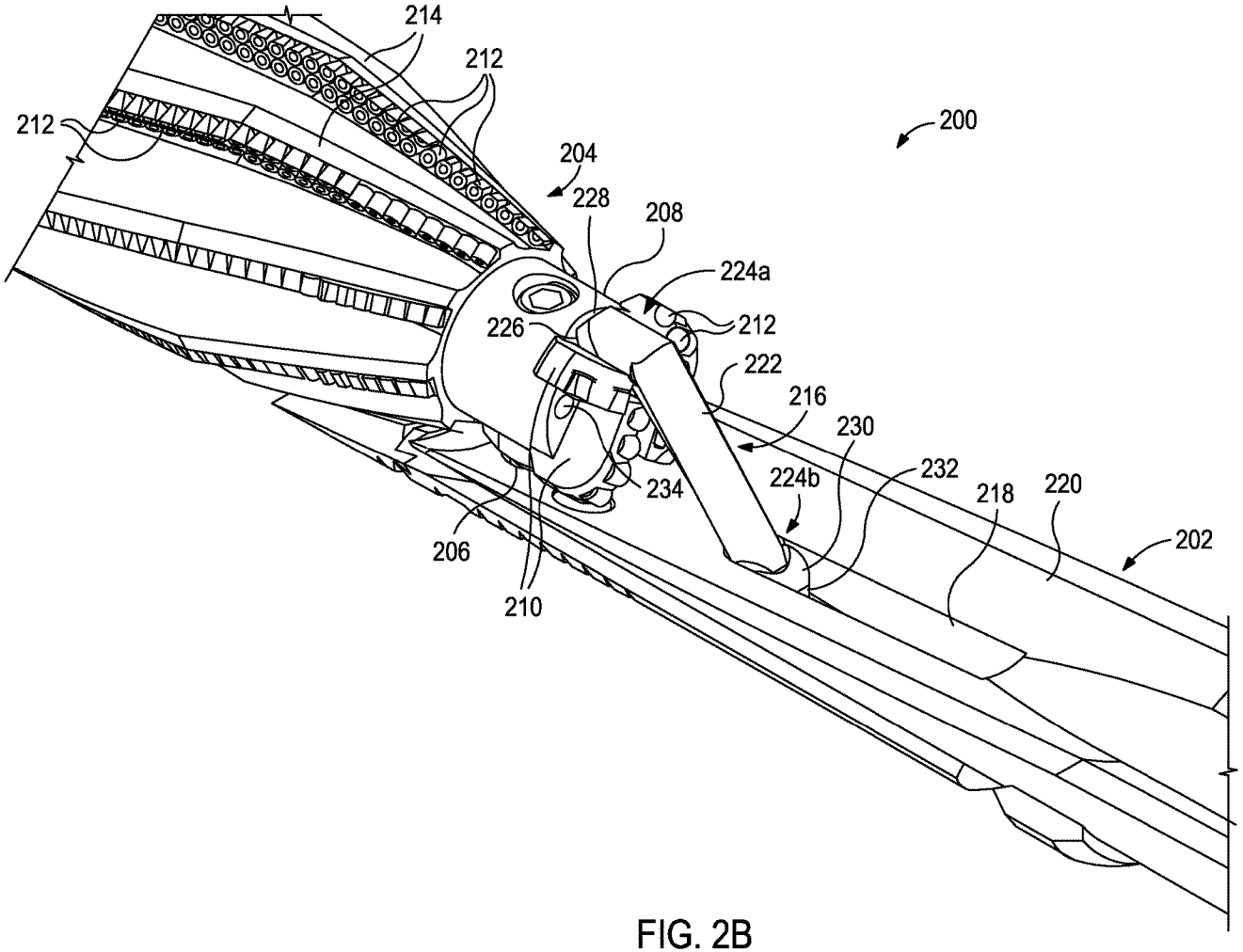

FIGS. 2A and 2B are isometric views of an exemplary whipstock assembly 200, according to one or more embodiments. The whipstock assembly 200 may be similar to or the same as the whipstock assembly 130 of FIG. 1 and, therefore, may be configured to be lowered into the wellbore 122 and secured therein to help facilitate the creation of the casing exit 134. As illustrated, the whipstock assembly 200 may include a whipstock 202 (alternately referred to as a "deflector") and at least one mill 204 (one shown) releasably coupled to the whipstock 202. As described in more detail below, the mill 204 may be secured to the whipstock 202 using a shear bolt 206 configured to fail (shear) upon assuming a predetermined axial load provided to the mill 204 and transferred to the shear bolt 206.

A mill head 208 is provided at an axial end of the mill 204, and a plurality of mill blades 210 (four shown) extend axially and radially from the mill head 208. One or more cutters 212 are secured to each mill blade 210 and are used to cut or mill through the casing 124 (FIG. 1) to initiate the formation of the casing exit 134 (FIG. 1). The mill 204 may also include a plurality of axially extending mill body blades 214 protruding radially outward from the body of the mill 204. Each mill body blade 214 may also include one or more cutters 212 that are operable to expand the size of the casing exit 134 as the mill 204 is extended therethrough.

The whipstock assembly 200 further includes a tension arm 216 pivotably coupled to the whipstock 202 and movable between a stowed position, as shown in FIG. 2A, and an engaged position, as shown in FIG. 2B. In the stowed position, the tension arm 216 is received and otherwise seated within a cavity 218 defined in a ramped surface 220 of the whipstock 202. The cavity 218 may be large (deep) enough so that the tension arm 216 rests flush with or below the ramped surface 220 when in the stowed position. Consequently, upon disengaging the mill 204 from the whipstock 202 and advancing downhole along the ramped surface 220, the tension arm 216 will be located below the ramped surface within the cavity 218 so as to not obstruct operation of the mill 204. In some embodiments, however, the tension arm 216 may be made of a millable material and the mill 204 may be configured to mill at least a portion of the tension arm 216 while advancing along the ramped surface 220.

The tension arm 216 provides an elongate, generally cylindrical body 222 having a first end 224*a* and a second end 224*b* opposite the first end 224*a*. The first end 224*a* provides an engagement head 226 that defines an engagement profile configured to mate with a corresponding mill profile 228 defined on a portion of the mill head 208. The second end 224*b* may be pivotably coupled to the whipstock 202. More particularly, one or more laterally extending lugs 230 may be provided at the second end 224*b* and received within corresponding orifices 232 (one shown) defined in opposing sidewalls of the cavity 218. The tension arm 216 may be configured to move between the stowed and engaged positions by pivoting about the second end 224*b* and, more specifically, about a longitudinal axis of the lug(s) 230 as received within the orifice(s) 232.

In the engaged position, as shown in FIG. 2B and as is described in more detail below, the engagement head 226 mates with the mill profile 228 and thereby allows the tension arm 216 to share tensile loads assumed by the shear bolt 206 while running and setting the whipstock assembly 200 within the wellbore 122 (FIG. 1). When it is desired to detach the mill 204 from the whipstock 202, an axial load is applied to the mill 204 in the downhole direction (i.e., to the right in FIGS. 2A and 2B), which is transferred to the shear bolt 206 that secures the mill 204 to the whipstock 202. Upon assuming a predetermined axial load, the shear bolt 206 will fail in shear and thereby free the mill 204 from the whipstock 202.

Shearing the shear bolt 206 allows the mill 204 to move relative to the whipstock 202, which may serve to disengage the tension arm 216 from the mill 204 and allow the tension arm 216 to pivot back to the stowed position within the cavity 218. In at least one embodiment, the tension arm 216 may be spring-loaded, such as with one or more torsion springs operatively coupled to the lugs 230. In such embodiments, the tension arm 216 may be naturally biased toward the stowed position and, once the shear bolt 206 is sheared, the engagement between the engagement head 226 and the mill profile 228 becomes disrupted and the spring-loaded lugs 230 may operate to pivot the tension arm 216 back to the stowed position.

In other embodiments, however, the tension arm 216 may be pivoted back to the stowed position under hydraulic force or pressure. More particularly, and as best seen in FIG. 2A, one or more flow ports 234 may be defined in the mill head 208, and at least one of the flow ports 234 may intersect or overlap the mill profile 228. When the tension arm 216 is in the engaged position, as shown in FIG. 2B, the flow port 234 intersecting the mill profile 228 is occluded by the engagement head 226. During operation of the mill 204, fluid circulates through the flow ports 234 to cool the mill 204 and clear debris and cuttings. Flowing the fluid through the flow port 234 intersecting the mill profile 228 will urge the engagement head 226 away from the mill profile 228 and impel the tension arm 216 to pivot back to the stowed position.

Figure 3A:
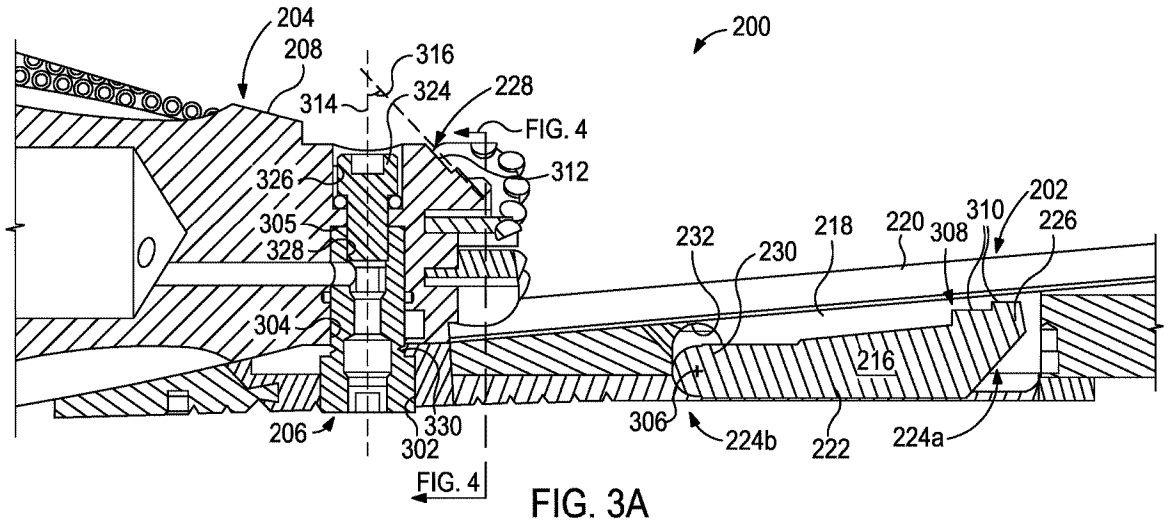
FIGS. 3A and 3B are cross-sectional side views of a portion of the whipstock assembly of FIGS. 2A and 2B.
Figure 3B:
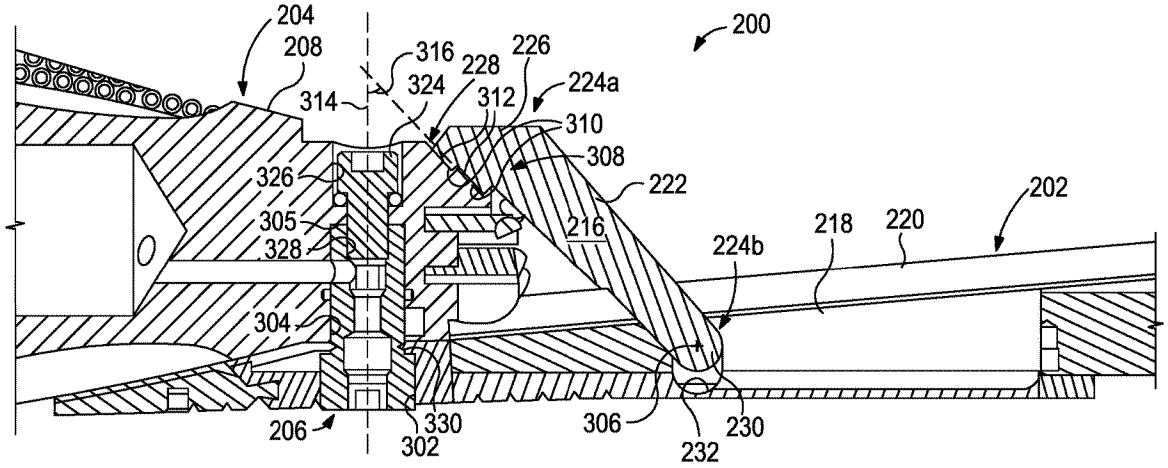

FIGS. 3A and 3B are cross-sectional side views of a portion of the whipstock assembly 200 of FIGS. 2A and 2B. More particularly, FIG. 3A shows the tension arm 216 in the stowed position, and FIG. 3B shows the tension arm 216 in the engaged position. The whipstock assembly 200 may be assembled by extending the shear bolt 206 through a threaded aperture 302 defined through the underside of the whipstock 202. The mill 204 may then be positioned such that the shear bolt 206 extends further into a shear bolt aperture 304 defined in the mill 204 and, more particularly, in the mill head 208. The threaded aperture 302 and the shear bolt aperture 304 may be configured to axially align to cooperatively receive the shear bolt 206. The shear bolt 206 extends within the shear bolt aperture 304 until axially engaging an inner end wall 305 defined within the shear bolt aperture 304.

The tension arm 216 may then be pivoted and otherwise rotated into engagement with the mill 204, as shown in FIG. 2B. More particularly, the tension arm 216 may be configured to pivot about a longitudinal axis 306 of the lug(s) 230 and thereby rotate out of the cavity 218. The tension arm 216 pivots until the engagement head 226 engages the mill profile 228 defined on the mill head 208.

As illustrated, the engagement head 226 may provide an engagement profile 308 configured to mate with the mill profile 228. In some embodiments, the engagement profile 308 may define one or more arm profile features 310 that are matable with one or more corresponding mill profile features 312 defined by the mill profile 228. In the illustrated embodiment, the matable arm and mill profile features 310, 312 comprise stepped surfaces that meet and mate at opposing 90° shoulders, although the shoulders could be angled above or below 90°, without departing from the scope of the disclosure. In other embodiments, however, the matable arm and mill profile features 310, 312 may comprise other designs or configurations, without departing from the scope of the disclosure.

Once the tension arm 216 is pivoted to the engaged position and the engagement head 226 engages the mill head 208 at the mill profile 228, the shear bolt 206 may be rotated about its central axis 314 to advance (thread) the shear bolt 206 through the threaded aperture 302 and thereby extend the shear bolt 206 deeper into the shear bolt aperture 304. Once the shear bolt 206 axially engages the inner end wall 305 within the shear bolt aperture 304, continued rotation of the shear bolt 206 within the threaded aperture 302 will cause the mill 204 to raise or lift away from the ramped surface 220 along the central axis 314. The mill 204 will then be radially and axially supported by the shear bolt 206.

As the mill 204 raises away from the ramped surface 220, the arm and mill profile features 310, 312 mate and resist movement of the mill 204 along the central axis 314. More particularly, the mill profile 228 may be defined on the mill head 208 at an angle 316 with respect to the central axis 314, and the arm and mill profile features 310, 322 may be generally defined perpendicular to the angle 316. Consequently, as the mill 204 raises away from the ramped surface 220 along the central axis 314, tension will be applied to the tension arm 216 as the arm and mill profile features 310, 322 matingly engage and resist relative movement. In some embodiments, the angle 316 may be about 45°, but could be more or less than 45°, without departing from the scope of the disclosure.

Figure 4A:
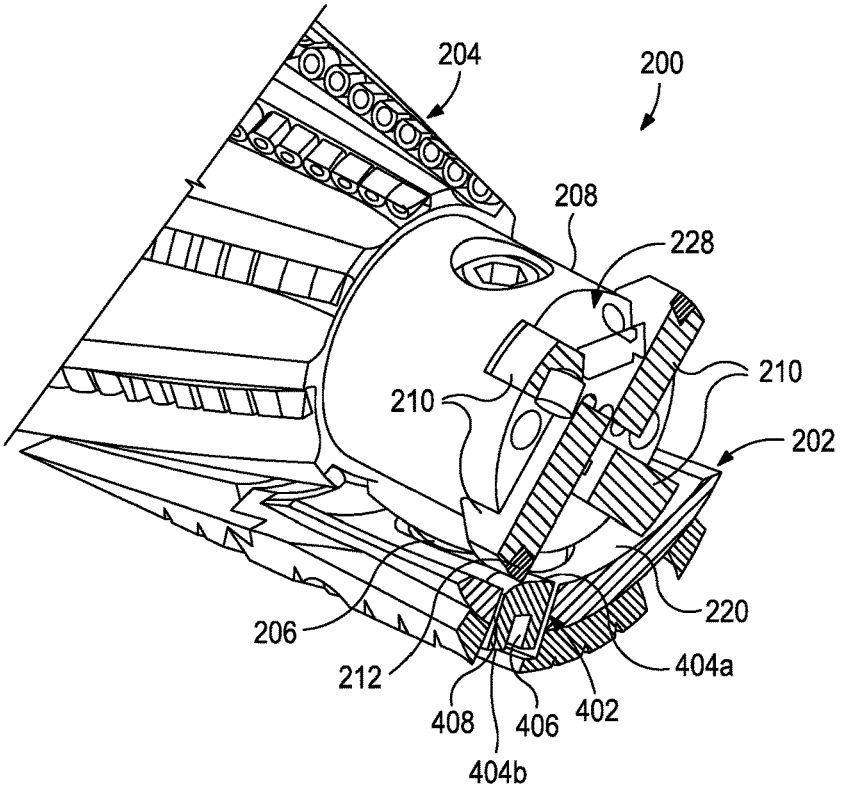
FIGS. 4A and 4B are cross-sectional isometric and end views, respectively, of the whipstock assembly of FIGS. 2A and 2B as taken along the lines 4-4 shown in FIG. 3A
Figure 4B:
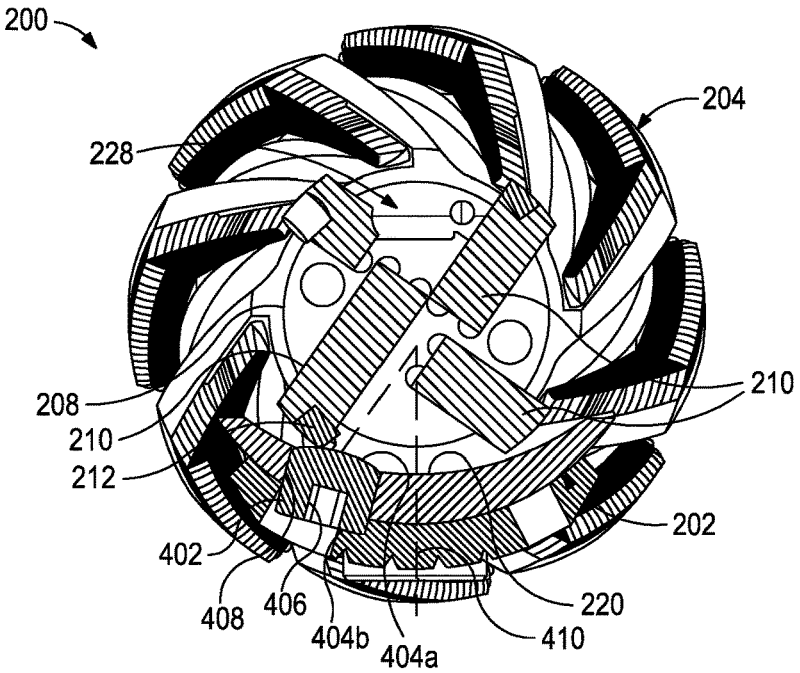

Referring briefly to FIGS. 4A and 4B, in at least one embodiment, once tension is applied to the tension arm 216 by rotating the shear bolt 206, a support button 402 may be used to pre-load the mill 204 against torque. More particularly, FIGS. 4A and 4B are cross-sectional isometric and end views of the whipstock assembly 200 as taken along the lines 4-4 shown in FIG. 3A. The support button 402 may have a first end 404*a* and a second end 404*b* opposite the first end 404*a*. The second end 404*b* includes a torque interface 406 that may be used to help rotate the support button 402. In the illustrated embodiment, the torque interface 406 comprises a hexagonal orifice configured to receive a correspondingly shaped socket wrench (e.g., an Allen socket).

The support button 402 may be threaded and configured to be received within a threaded button aperture 408 defined through the whipstock 202. Rotating the threaded button 402 within the threaded button aperture 408 will cause the first end 404*a* to progressively advance out of the threaded button aperture 408 and past (away from) the ramped surface 220. Continued advancement of the support button 402 out of the threaded button aperture 408 brings the first end 404*a* into engagement with the mill 204 and, more particularly, into engagement with one of the mill blades 210 provided on the mill head 208. In at least one embodiment, the mill blade 210 may be situated such that the first end 404*a* engages a cutter 212 secured to the mill blade 210.

As best seen in FIG. 4B, the support button 402 may be laterally or angularly offset from a vertical center 410 of the ramped surface 220 where the shear bolt 206 penetrates the whipstock 202. Tightening the support button 402 against the mill blade 210 effectively occupies or takes up the gap formed between the ramped surface 220 and the mill 204 as a result of rotating the shear bolt 206 to apply tension in the tension arm 216, as described above. Since the support button 402 is angularly offset from the shear bolt 206, the mill 204 will be radially supported at two locations; i.e., along the vertical center 410 via the shear bolt 206 and at an angle offset from the vertical center 410 via the support button 402. As a result, it will be difficult for the mill 204 to rotate and develop torque moments that might prematurely fail the shear bolt 206 in torsion. Instead, any torque assumed by the mill 204 during downhole operation will be transferred to the shear bolt 206 (FIG. 4A) in the form of a tensile load, and such tensile loads will be assumed in part by the tension arm 216 (FIGS. 3A-3B) as engaged with the mill head 208. As will be appreciated, this will effectively increase the tensile limit of the shear bolt 206 and reduce the probability that the shear bolt 206 will fatigue prematurely.

Referring again to FIGS. 3A-3B, once the support button 402 (FIGS. 4A-4B) is engaged against the mill 204, as described above, the shear bolt 206 may be secured within the mill 204 (i.e., the mill head 208) with a cap screw 324 that is extendable into a cap screw aperture 326 defined in the top of the mill head 208. As illustrated, the cap screw aperture 326 may be aligned with and otherwise form a contiguous axial extension or portion of the shear bolt aperture 304. The cap screw 324 may be threadably secured to the shear bolt 206 at a threaded cavity 328 defined in the end of the shear bolt 206. Once the cap screw 324 is threaded to the threaded cavity 328, the mill 204 becomes effectively coupled to the whipstock 202 via the coupled engagement between the cap screw 324 and the shear bolt 206.

Exemplary operation of the assembled whipstock assembly 200 is now provided. The whipstock assembly 200 may be lowered downhole within the wellbore 122 (FIG. 1) with the mill 204 secured to the whipstock 202 as generally described above. Upon reaching a location in the wellbore 122 where the casing exit 134 (FIG. 1) is to be formed, the whipstock assembly 200 is latched into the anchor assembly 134 (FIG. 1) previously arranged within the wellbore 122. Latching in the whipstock assembly 200 may include extending the whipstock assembly 200 into the anchor assembly 134 and then rotating the whipstock assembly 200 as the whipstock assembly 200 is pulled back uphole or toward the well surface.

As the whipstock assembly 200 is advanced downhole and subsequently latched into the anchor assembly 134 (FIG. 1), the mill 204 assumes varying magnitudes of torsional loading. Since the mill 204 is supported radially by the shear bolt 206 and the offset support button 402 (FIGS. 4A-4B), such torsional loads will tend to lift the mill 402 off the ramped face 220. The mill 204, however, is held in place relative to the ramped face 220 by the shear bolt 206, which assumes a tensile load resulting from the applied torsional load. As torque on the mill 204 increases, the tensile load assumed by the shear bolt 206 correspondingly increases. With the tension arm 216 engaged with the mill head 208, however, the arm and mill profile features 310, 312 transfer at least a portion of the tensile load to the tension arm 216. Accordingly, the tension arm 216 effectively increases the tensile limit of the shear bolt 206 and correspondingly increases the torque rating of the whipstock assembly 200.

Once the whipstock assembly 200 is properly latched into the anchor assembly 134 (FIG. 1), weight is set down on the whipstock assembly 200 from a surface location, which places an axial load on the mill 204 that is transferred to the shear bolt 206. Upon assuming a predetermined axial load, the shear bolt 206 fails in shear and thereby frees the mill 204 from axial engagement with the whipstock 202. The shear bolt 206 may define or otherwise provide a shear groove 330, depicted in FIGS. 3A-3B as a circumferential indentation defined about the outer periphery of the shear bolt 206. The shear groove 330 provides a shear plane configured to fail upon assuming the predetermined axial load. In at least one embodiment, the shear groove 330 is defined generally perpendicular to the central axis 314 and in line with the ramped surface 220, which makes the shear plane generally parallel to the ramped surface 220. This may prove advantageous in being able to advance the shear bolt 206 within the threaded aperture 302 along the central axis 314 to load the tension arm 216 without altering the general orientation of the shear plane. Moreover, since the shear plane is generally parallel to the ramped surface 220, the remnant of the shear bolt 206 following shearing that remains on the ramped surface 220 is also parallel to the ramped surface 220 and, therefore, will not protrude from the ramped surface 220 and damage or stall the mill 204 as it advances.

Since the engagement profile 308 mates with the mill profile 228 at the angle 316 with respect to the central axis 314, the mill 204 may be able to disengage the engagement head 226 from the mill profile 228 upon moving in the downhole direction (i.e., to the right in FIGS. 3A-3B). As mentioned above, as the mill 204 moves relative to the whipstock 202 in the downhole direction, the tension arm 216 may be pivoted back to the stowed position within the cavity 218. In other embodiments, however, once the tension arm 216 is disengaged from the mill head 208, spring-loaded lugs 230 may help pivot the tension arm 216 back to the stowed position. In yet other embodiments, flow of a fluid through the mill 204 and out the flow ports 234 (FIGS. 2A-2B) defined in the mill head 208 may hydraulically force the engagement head 226 away from the mill profile 228 and impel the tension arm 216 to pivot back to the stowed position.

Once free from the whipstock 202 and the tension arm 216, the mill 204 may then be rotated about a central axis and simultaneously advanced in the downhole direction. As it advances downhole, the mill 204 rides up the ramped surface 220 of the whipstock 202 until engaging and milling the inner wall of the casing 124 (FIG. 1) to form the casing exit 134 (FIG. 1).

Embodiments disclosed herein include:

A. A whipstock assembly that includes a whipstock providing a ramped surface, a mill releasably coupled to the whipstock with a shear bolt and providing a mill profile, and a tension arm pivotably coupled to the whipstock and movable between a stowed position, where the tension arm is received within a cavity defined in the ramped surface, and an engaged position, where an engagement head of the tension arm mates with the mill profile to share at least a portion of a tensile load assumed by the shear bolt.

B. A method that includes conveying a whipstock assembly into a wellbore, the whipstock assembly including a whipstock having a ramped surface, a mill releasably coupled to the whipstock with a shear bolt and providing a mill profile, and a tension arm pivotably coupled to the whipstock and having an engagement head engaged with the mill profile. At least a portion of a tensile load applied to the shear bolt is assumed with the tension arm as the whipstock assembly moves within the wellbore.

C. A method of assembling a whipstock assembly that includes extending a shear bolt through a threaded aperture defined through a whipstock, positioning a mill on the whipstock such that the shear bolt extends into a shear bolt aperture defined in the mill, pivoting a tension arm into engagement with a mill profile defined on the mill, the tension arm being pivotably coupled to the whipstock, rotating the shear bolt within the threaded aperture and thereby raising the mill away from the ramped surface, mating an engagement profile of the tension arm with the mill profile as the mill raises away from the ramped surface and thereby placing the tension arm in tension, advancing a support button out of a threaded button aperture and into radial engagement with the mill, wherein the threaded button aperture is defined through the whipstock and angularly offset from a vertical center of the ramped surface where the shear bolt penetrates the whipstock, and extending a cap screw into a cap screw aperture defined in the mill and threading the cap screw to the shear bolt at a threaded cavity defined in the shear bolt.

Each of embodiments A, B, and C may have one or more of the following additional elements in any combination: Element 1: wherein the mill comprises a mill head provided at an axial end of the mill, and a plurality of mill blades positioned on the mill head, wherein the mill profile is defined between angularly adjacent mill blades of the plurality of mill blades. Element 2: wherein the tension arm comprises a body having a first end and a second end, wherein the engagement head is provided at the first end, and one or more lugs provided at the second end and received within a corresponding one or more orifices defined in the cavity, wherein the tension arm pivots about a longitudinal axis of the one or more lugs to move between the stowed and engaged positions. Element 3: wherein the tension arm is spring-loaded and naturally biased toward the stowed position. Element 4: wherein the engagement head provides an engagement profile defining one or more arm profile features and being matable with one or more mill profile features defined on the mill profile. Element 5: wherein the one or more arm profile features and the one or more mill profile features comprise matable stepped surfaces. Element 6: wherein the mill profile is defined on the mill at an angle offset from a central axis of the shear bolt. Element 7: further comprising a threaded button aperture defined through the whipstock and angularly offset from a vertical center of the ramped surface where the shear bolt penetrates the whipstock, and a support button received within the threaded button aperture and being rotatable to advance out of the threaded button aperture to engage the mill. Element 8: wherein a shear groove is defined about an outer periphery of the shear bolt and extends perpendicular to a central axis of the shear bolt.

Element 9: wherein the engagement head provides an engagement profile defining one or more arm profile features and the mill profile defines one or more mill profile features, and wherein assuming at least a portion of the tensile load applied to the shear bolt with the tension arm comprises mating the one or more arm profile features with the one or more mill profile features and thereby preventing relative movement between the engagement profile and the mill profile. Element 10: further comprising placing an axial load on the shear bolt via the mill and thereby shearing the shear bolt to free the mill from engagement with the whipstock, disengaging the engagement head from the mill profile, and pivoting the tension arm to a stowed position where the tension arm is received within a cavity defined in the ramped surface. Element 11: wherein pivoting the tension arm to the stowed position comprises moving the mill in a downhole direction, and engaging the tension arm with the mill as the mill moves in the downhole direction. Element 12: wherein the tension arm is spring-loaded and naturally biased toward the stowed position and wherein pivoting the tension arm to the stowed position comprises rotating the tension arm under spring force to the stowed position. Element 13: wherein the mill defines one or more flow ports and pivoting the tension arm to the stowed position comprises circulating a fluid through the one or more flow ports, at least one of the one or more flow ports intersecting the mill profile and being occluded with the engagement head, and impinging the fluid on the engagement head and thereby moving the tension arm to the stowed position.

Element 14: wherein the tension arm provides a first end and a second end, the engagement profile being defined at the first end and one or more lugs being provided at the second end, and wherein pivoting the tension arm into engagement with the mill profile comprises pivoting the tension arm about a longitudinal axis of the one or more lugs as received within a corresponding one or more orifices defined in a cavity defined in the whipstock. Element 15: wherein the engagement profile defines one or more arm profile features and the mill profile defines one or more mill profile features, and wherein mating the engagement profile with the mill profile comprises mating the one or more arm profile features with the one or more mill profile features. Element 16: wherein advancing the support button out of the threaded button aperture and into engagement with the mill comprises engaging the support button against a cutter secured to a mill blade provided on the mill.

By way of non-limiting example, exemplary combinations applicable to A, B, and C include: Element 4 with Element 5; Element 4 with Element 6; Element 10 with Element 11; Element 10 with Element 12; and Element 10 with Element 13.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A whipstock assembly, comprising:

a whipstock providing a ramped surface;

a mill releasably coupled to the whipstock with a shear bolt and providing a mill profile; and a tension arm pivotably coupled to the whipstock and movable between a stowed position, where the tension alai is received within a cavity defined in the ramped surface, and an engaged position, where an engagement head of the tension arm mates with the mill profile to assume at least a portion of a tensile load assumed by the shear bolt, wherein the engagement head provides an engagement profile defining one or more arm profile features and being matable with one or more mill profile features defined on the mill profile, wherein the one or more arm profile features and the one or more mill profile features comprise matable stepped surfaces, wherein the mill profile is defined on the mill at an angle offset from a central axis of the shear bolt.

2. The whipstock assembly of claim 1, wherein the mill comprises:

a mill head provided at an axial end of the mill; and a plurality of mill blades positioned on the mill head, wherein the mill profile is defined between angularly adjacent mill blades of the plurality of mill blades.

3. The whipstock assembly of claim 1, wherein the tension arm comprises:

a body having a first end and a second end, wherein the engagement head is provided at the first end; and one or more lugs provided at the second end and received within a corresponding one or more orifices defined in the cavity, wherein the tension arm pivots about a longitudinal axis of the one or more lugs to move between the stowed and engaged positions.

4. The whipstock assembly of claim 1, wherein the tension arm is spring-loaded and naturally biased toward the stowed position.

5. The whipstock assembly of claim 1, further comprising:

a threaded button aperture defined through the whipstock and angularly offset from a vertical center of the ramped surface where the shear bolt penetrates the whipstock; and a support button received within the threaded button aperture and being rotatable to advance out of the threaded button aperture to engage the mill.

6. The whipstock assembly of claim 1, wherein a shear groove is defined about an outer periphery of the shear bolt and extends perpendicular to a central axis of the shear bolt.

7. A method, comprising:

conveying a whipstock assembly into a wellbore, the whipstock assembly including a whipstock having a ramped surface, a mill releasably coupled to the whipstock with a shear bolt and providing a mill profile, and a tension arm pivotably coupled to the whipstock and having an engagement head engaged with the mill profile, wherein the engagement head provides an engagement profile defining one or more arm profile features and the mill profile defines one or more mill profile features; and assuming at least a portion of a tensile load applied to the shear bolt with the tension arm as the whipstock assembly moves within the wellbore, wherein assuming at least a portion of the tensile load applied to the shear bolt with the tension arm comprises:

mating the one or more arm profile features with the one or more mill profile features and thereby preventing relative movement between the engagement profile and the mill profile.

8. The method of claim 7, wherein the whipstock assembly further includes a threaded button aperture defined through the whipstock and angularly offset from a vertical center of the ramped surface where the shear bolt penetrates the whipstock, the method further comprising:

assuming a torsional load with the mill as the whipstock assembly moves within the wellbore;

radially supporting the mill with the shear bolt and a support button received within the threaded button aperture and thereby converting the torsional load into the tensile load; and cooperatively assuming the tensile load with the shear bolt and the tension arm as the tension arm engages the mill profile.

9. The method of claim 7, further comprising:

placing an axial load on the shear bolt via the mill and thereby shearing the shear bolt to free the mill from engagement with the whipstock;

disengaging the engagement head from the mill profile; and pivoting the tension arm to a stowed position where the tension arm is received within a cavity defined in the ramped surface.

10. The method of claim 9, wherein pivoting the tension arm to the stowed position comprises:

moving the mill in a downhole direction; and engaging the tension arm with the mill as the mill moves in the downhole direction.

11. The method of claim 9, wherein the tension arm is spring-loaded and naturally biased toward the stowed position and wherein pivoting the tension arm to the stowed position comprises rotating the tension arm under spring force to the stowed position.

12. The method of claim 9, wherein the mill defines one or more flow ports and pivoting the tension arm to the stowed position comprises:

circulating a fluid through the one or more flow ports, at least one of the one or more flow ports intersecting the mill profile and being occluded with the engagement head; and impinging the fluid on the engagement head and thereby moving the tension arm to the stowed position.

13. A method of assembling a whipstock assembly, comprising:

extending a shear bolt through a threaded aperture defined through a whipstock;

positioning a mill on the whipstock such that the shear bolt extends into a shear bolt aperture defined in the mill;

pivoting a tension arm into engagement with a mill profile defined on the mill, the tension arm being pivotably coupled to the whipstock;

rotating the shear bolt within the threaded aperture and thereby raising the mill away from the ramped surface;

mating an engagement profile of the tension arm with the mill profile as the mill raises away from the ramped surface and thereby placing the tension arm in tension;

advancing a support button out of a threaded button aperture and into radial engagement with the mill, wherein the threaded button aperture is defined through the whipstock and angularly offset from a vertical center of the ramped surface where the shear bolt penetrates the whipstock; and extending a cap screw into a cap screw aperture defined in the mill and threading the cap screw to the shear bolt at a threaded cavity defined in the shear bolt.

14. The method of claim 13, wherein the tension aim provides a first end and a second end, the engagement profile being defined at the first end and one or more lugs being provided at the second end, and wherein pivoting the tension arm into engagement with the mill profile comprises:

pivoting the tension arm about a longitudinal axis of the one or more lugs as received within a corresponding one or more orifices defined in a cavity defined in the whipstock.

15. The method of claim 13, wherein the engagement profile defines one or more arm profile features and the mill profile defines one or more mill profile features, and wherein mating the engagement profile with the mill profile comprises mating the one or more arm profile features with the one or more mill profile features.

16. The method of claim 13, wherein advancing the support button out of the threaded button aperture and into engagement with the mill comprises engaging the support button against a cutter secured to a mill blade provided on the mill.

17. A method, comprising:

conveying a whipstock assembly into a wellbore, the whipstock assembly including a whipstock having a ramped surface, a mill releasably coupled to the whipstock with a shear bolt and providing a mill profile, a threaded button aperture defined through the whipstock and angularly offset from a vertical center of the ramped surface where the shear bolt penetrates the whipstock, and a tension arm pivotably coupled to the whipstock and having an engagement head engaged with the mill profile;

assuming at least a portion of a tensile load applied to the shear bolt with the tension arm as the whipstock assembly moves within the wellbore;

assuming a torsional load with the mill as the whipstock assembly moves within the wellbore;

radially supporting the mill with the shear bolt and a support button received within the threaded button aperture and thereby converting the torsional load into the tensile load; and cooperatively assuming the tensile load with the shear bolt and the tension arm as the tension arm engages the mill profile.

18. A method, comprising:

conveying a whipstock assembly into a wellbore, the whipstock assembly including a whipstock having a ramped surface, a mill releasably coupled to the whipstock with a shear bolt and providing a mill profile, wherein the mill defines one or more flow ports, and a tension arm pivotably coupled to the whipstock and having an engagement head engaged with the mill profile;

assuming at least a portion of a tensile load applied to the shear bolt with the tension arm as the whipstock assembly moves within the wellbore;

placing an axial load on the shear bolt via the mill and thereby shearing the shear bolt to free the mill from engagement with the whipstock;

disengaging the engagement head from the mill profile; and pivoting the tension arm to a stowed position where the tension arm is received within a cavity defined in the ramped surface, wherein the tension arm is spring-loaded and naturally biased toward the stowed position, wherein pivoting the tension arm to the stowed position comprises:

rotating the tension arm under spring force to the stowed position;

moving the mill in a downhole direction;

engaging the tension arm with the mill as the mill moves in the downhole direction;

circulating a fluid through the one or more flow ports, at least one of the one or more flow ports intersecting the mill profile and being occluded with the engagement head; and impinging the fluid on the engagement head and thereby moving the tension arm to the stowed position.

19. A whipstock assembly, comprising:

a whipstock providing a ramped surface;

a mill releasably coupled to the whipstock with a shear bolt and providing a mill profile; and a tension arm pivotably coupled to the whipstock and movable between a stowed position, where the tension arm is received within a cavity defined in the ramped surface, and an engaged position, where an engagement head of the tension arm mates with the mill profile to assume at least a portion of a tensile load assumed by the shear bolt, wherein the tension arm comprises:

a body having a first end and a second end, wherein the engagement head is provided at the first end; and one or more lugs provided at the second end and received within a corresponding one or more orifices defined in the cavity, wherein the tension arm pivots about a longitudinal axis of the one or more lugs to move between the stowed and engaged positions.

20. A whipstock assembly, comprising:

a whipstock providing a ramped surface;

a mill releasably coupled to the whipstock with a shear bolt and providing a mill profile;

a tension arm pivotably coupled to the whipstock and movable between a stowed position, where the tension aim is received within a cavity defined in the ramped surface, and an engaged position, where an engagement head of the tension arm mates with the mill profile to assume at least a portion of a tensile load assumed by the shear bolt;

a threaded button aperture defined through the whipstock and angularly offset from a vertical center of the ramped surface where the shear bolt penetrates the whipstock; and a support button received within the threaded button aperture and being rotatable to advance out of the threaded button aperture to engage the mill.

* * * * *